US005770810A

United States Patent [19]

Lombardi

[11] Patent Number: 5,770,810

[45] Date of Patent: Jun. 23, 1998

[54] DRUM TUNING METHOD AND APPARATUS

[75] Inventor: Donald G. Lombardi, Thousand Oaks, Calif.

[73] Assignee: Drum Workshop, Inc., Oxnard, Calif.

[21] Appl. No.: 846,233

[22] Filed: Apr. 28, 1997

[51] Int. Cl.[6] ..... G10D 13/02

[52] U.S. Cl. ..... 84/411 R; 84/454

[58] Field of Search ..... 84/411 R, 411 A, 84/454

[56] References Cited

U.S. PATENT DOCUMENTS 4,023,462 5/1977 Denov et al. ..... 84/454

*Primary Examiner*—Michael L. Gellner
*Assistant Examiner*—Shih-yung Hsieh
*Attorney, Agent, or Firm*—William W. Haefliger

[57] ABSTRACT

The method of enabling optimum tuning of a drum having a shell, a head and adjustable tuning members, that includes suspending the drum shell to vibrate when struck; striking the suspended shell to vibrate at a characteristic acoustic frequency; sensing the acoustic frequency and converting the sensed acoustic frequency to a labeling value; and using the value to label the drum to indicate the frequency; whereby a drum user may tune the drum by adjusting the members to cause the drum to resonate at or near the frequency when the head is truck.

13 Claims, 3 Drawing Sheets

DRUM TUNING METHOD AND APPARATUS

BACKGROUND OF THE INVENTION

This invention relates generally to tuning of drums, and more particularly, to method and apparatus to optimize such tuning.

There is need for simple method and apparatus to more effectively tune drums. Typically, when tuning rods associated with tuning lugs at the sides of drum shells are adjusted, the drum head is repeatedly struck in an effort to realize optimum acoustic output, i.e., sound quality, of the drum when struck with a beater. It is found that this effort is tedious and inexact, since the user does not know at what tone level the drum acoustic output becomes optimized.

SUMMARY OF THE INVENTION

It is a major object of the invention to provide improved technique, i.e., method, and also apparatus, to meet the above need. Basically, the method of achieving optimum tuning of a drum having a shell, a head or heads, and adjustable tuning members, includes the following steps:

a) suspending the drum shell, during drum manufacture, to vibrate when struck, b) striking the suspended shell to vibrate at a characteristic acoustic frequency, c) sensing the acoustic frequency and converting the sensed acoustic frequency to a labeling value, d) and using the value to label the drum to indicate the frequency, e) whereby a drum user may tune the drum by adjusting the members to cause the drum to resonate at or near the frequency when the head is struck.

As will be seen, such sensing may advantageously include locating an acoustic vibration pickup transducer at a position to sense the acoustic frequency and to produce an electric signal or signals representative of the frequency, and converting the electric signal or signals into labeling value.

Another object is to effect drum labeling, as during manufacture, by applying the determined tone-indicating label to the drum shell surface, the label indicating the determined label value. The label may be provided in the form of a tone indicator, incorporating a readable or visible signal.

A further object includes producing the tone corresponding to the indicator independently of the drum, and including striking the drum head and adjusting the rods until the drum resonates when so struck at a tone level the same as or near the independently produced tone.

Yet another object includes providing the pickup transducer in the form of a microphone, or equivalent; and also providing circuitry connected to the microphone and operable to provide an interpretable (for example, visible) indication of the characteristic frequency at which the drum shell resonates when struck.

An additional object includes effecting drum shell suspension by providing a local support engaging the shell surface internally of the shell, and at a shell-balancing position. That support may effectively be provided in the form of a supporting local edge or point engaging the drum interior surface.

Additional objects include provision of structure or means by which the above steps may be effected.

These and other objects and advantages of the invention, as well as the details of an illustrative embodiment, will be more fully understood from the following specification and drawings, in which:

DRAWING DESCRIPTION

FIG. 1 is a perspective view showing a completed drum;

FIG. 1*a* is a section showing buffing of a drum shell; and

FIG. 2 is a section showing components useful in determining the characteristic tone of a resonating drum shell.

DETAILED DESCRIPTION

Figure 1:
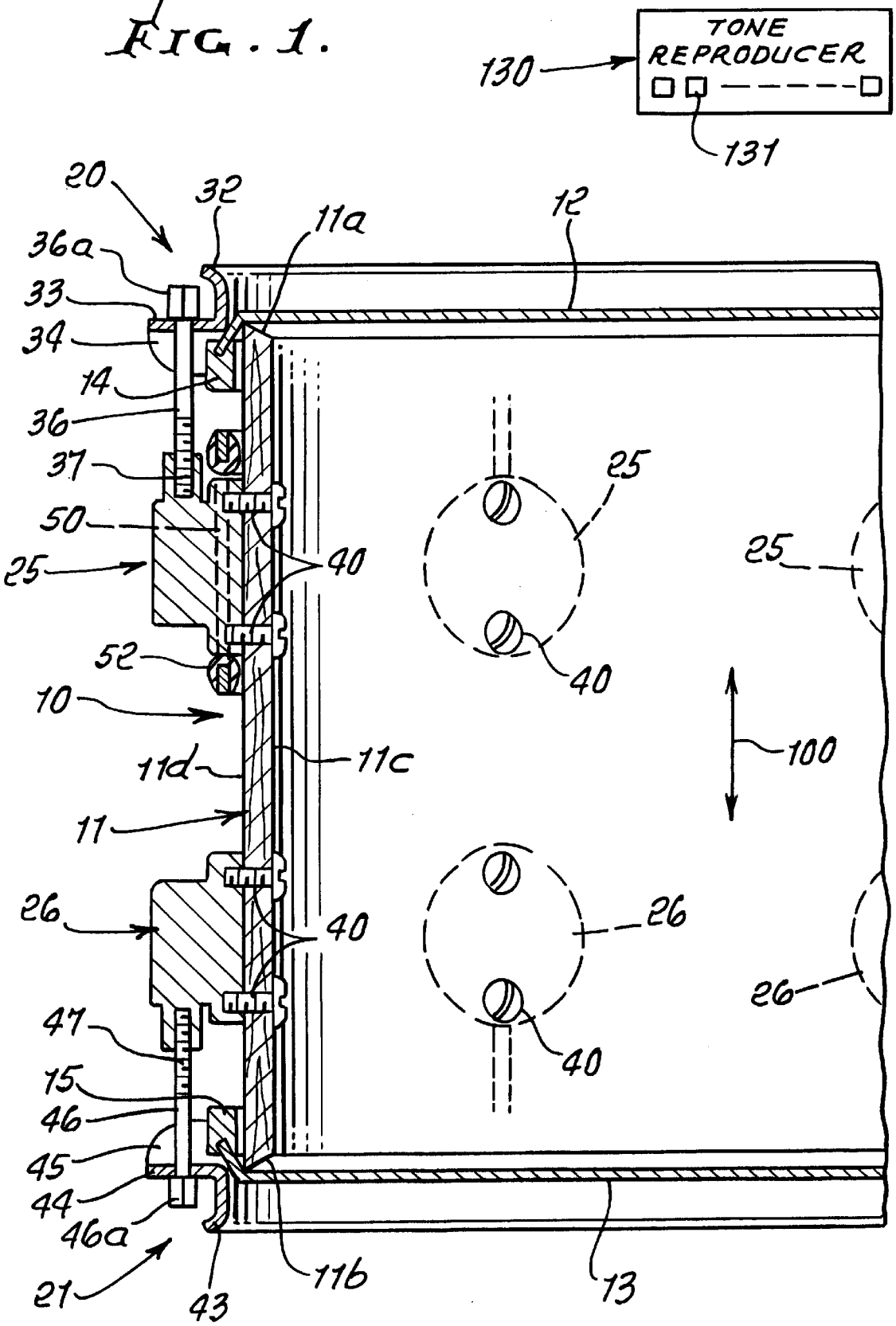

By way of example, FIG. 1 shows a complete drum 10 having a cylindrical section or section located in axially extending position. Drum 10 may be a tom-tom.

Opposite annular and inwardly angled ends of the shell appear at 11*a* and 11*b* in FIG. 1. The shell typically consists of wood and has inner and outer cylindrical walls 11*c* and 11*d*.

Drum heads 12 and 13 extend over the shell ends 11*a* and 11*b* and are retained in taut condition. They may consist of thin sheets of plastic or other material. Annular metallic flanges 14 and 15 are typically attached to the respective heads 12 and 13 for retaining them in taut condition. Flanges 14 and 15 extend about opposite end extents of the shell.

The retainer structure shown includes flange structure 20 provided in association with one end 11*a* of the shell, and flange structure 21 in association with the other end 11*b* of the shell.

The upper flange structure 20 has an upwardly extending annular rim portion 32 extending above the level of drumhead 12, a medial annular portion 33 extending radially outwardly below the level of 32, for transmitting head tightening loading to flange 14, and a lower annular extending portion 34 extending downwardly from the outer extent of 33. A tightening adjustment fastener rod 36 extends downwardly through 33 and has external threads 37 that interfit internal threads in upper holder or stud 25. Note fastener head 36*a* bearing on the upper surface of 33. The lower surface of 33 exerts downward loading onto retention ring of flange to which drumhead 12 is attached, for adjusting its tautness, by drawing the head over 11*a*.

Likewise, lower flange structure 21 has a downwardly extending annular rim portion 43 extending below the level of drumhead 13, a medial annular portion 44 extending radially outwardly above the level of 43 for transmitting head tightening loading, and an upper annularly extending portion 45 extending upwardly from outer extent of 44. A tightening adjusting fastener rod 46 extends upwardly through 44 and has external threads 47 that interfit rotatably the internal threads in lower holder or stud 26. Note fastener head 46*a* bearing on the lower surface of 44. The upper surface of 44 exerts upward loading onto lower retention ring or flange 15 to which drumhead 13 is attached, for adjusting its tautness, i.e., over bevel 11*b*. Fasteners 40 connect 25 and 26 to 11. Accordingly, the drumheads are individually adjustable, and acoustic benefits are enabled, while the drumheads are stretched over metal edges, with acoustic benefits.

A support band extends loosely about the shell 11, and at least part way about the studs 25 and 26; and elastomer cushions are carried by the support band and extend at least part way about the studs and adjacently face the shell to cushion axial and side loading transferred between the studs and support band, and to acoustically isolate the shell and support band; and drum support structure supports the support band.

In the example shown, the metallic support band 50 extends through an arc about the drum axis, that arc typically being between about 170° and 190°, whereby multiple of the upper studs 25 are spanned. As shown, four of the upper studs are spanned to provide multiple supports for the band, with drum loading transferred to the band directly from the shell, via 40 and 25, and cushions to be described.

Relatively large size (diameter) elastomer cushions 52 are carried by the band 50 to receive drum side loading and drum axial loading, such side loading imposed directly from the shell to the annular side faces of the cushions (see FIG. 2), as the drum may be moved sidewardly back and forth during heavy use.

The generally annular cushions typically extend closely about the studs 25 in arcuate planes substantially parallel to the drum axis and to 11*d*, and in isolation from the tensioning rods 36 and retainer structures 20 and 14, as shown. Note that the cushions extend closer to the shell than band extent adjacent the cushions. At least one of the multiple cushions engages the shell to receive imposed loading, and various of the cushions may engage shell wall 11*d* if the drum moves about, as during marching.

It will be noted that the adjustment rods 36 and 47 are adjustable to adjust the tension exerted in the direction 100 on the shell. Such tension affects the frequency or frequencies at which the drum vibrates, when struck, to produce sound. It is desirable to adjust that frequency or frequencies to be at or near the characteristic resonant frequency of the drum shell itself, for optimum acoustic output of the drum.

Figure 1A:
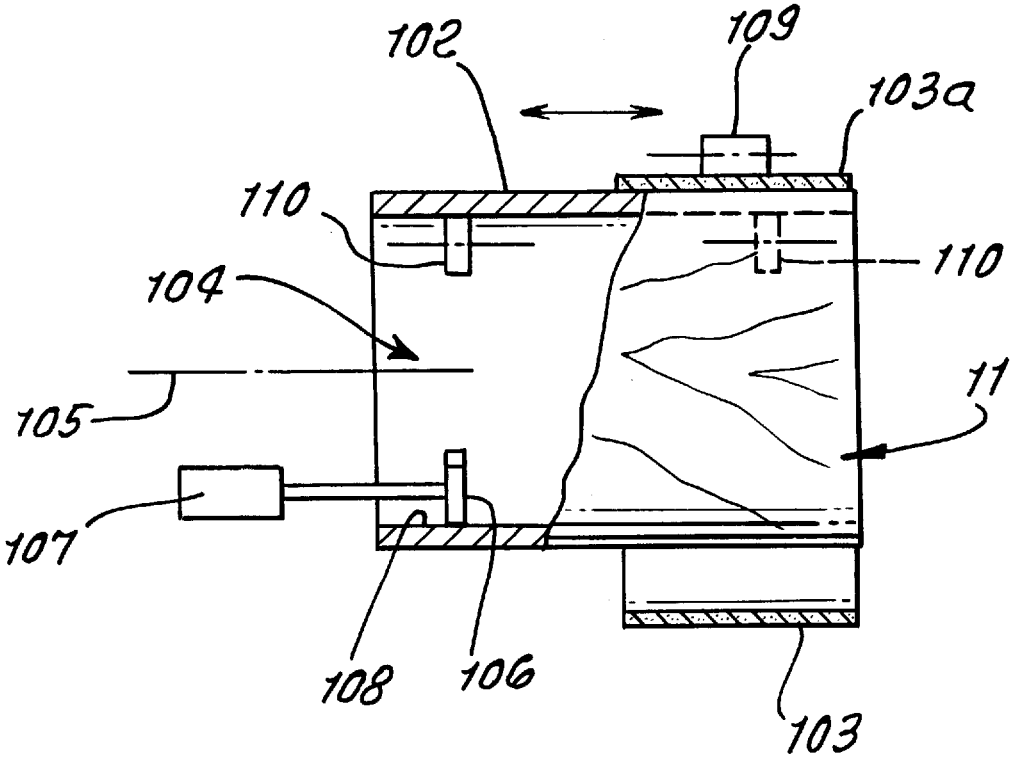

Referring to FIG. 1*a*, the shell itself, typically consisting of wood, may be preliminarily buffed at its outer surface 102. A looping, buffing belt is shown at 103, traveling into and out of the plane of FIG. 1*a*, in contact with the drum surface. A pusher 109 urges the belt upper stretch 103*a* against the drum cylindrical surface 102, which is independently driven at 104 about drum axis 105. Note drive rotor 106, driven at 107, and engaging the drum inner surface 108 to rotate the drum. Idler rotors 110 engage surface 108 to support the rotating drum. Buffing of the shell surface tends to sharpen the characteristic resonant frequency of the drum shell, when struck.

Figure 2:
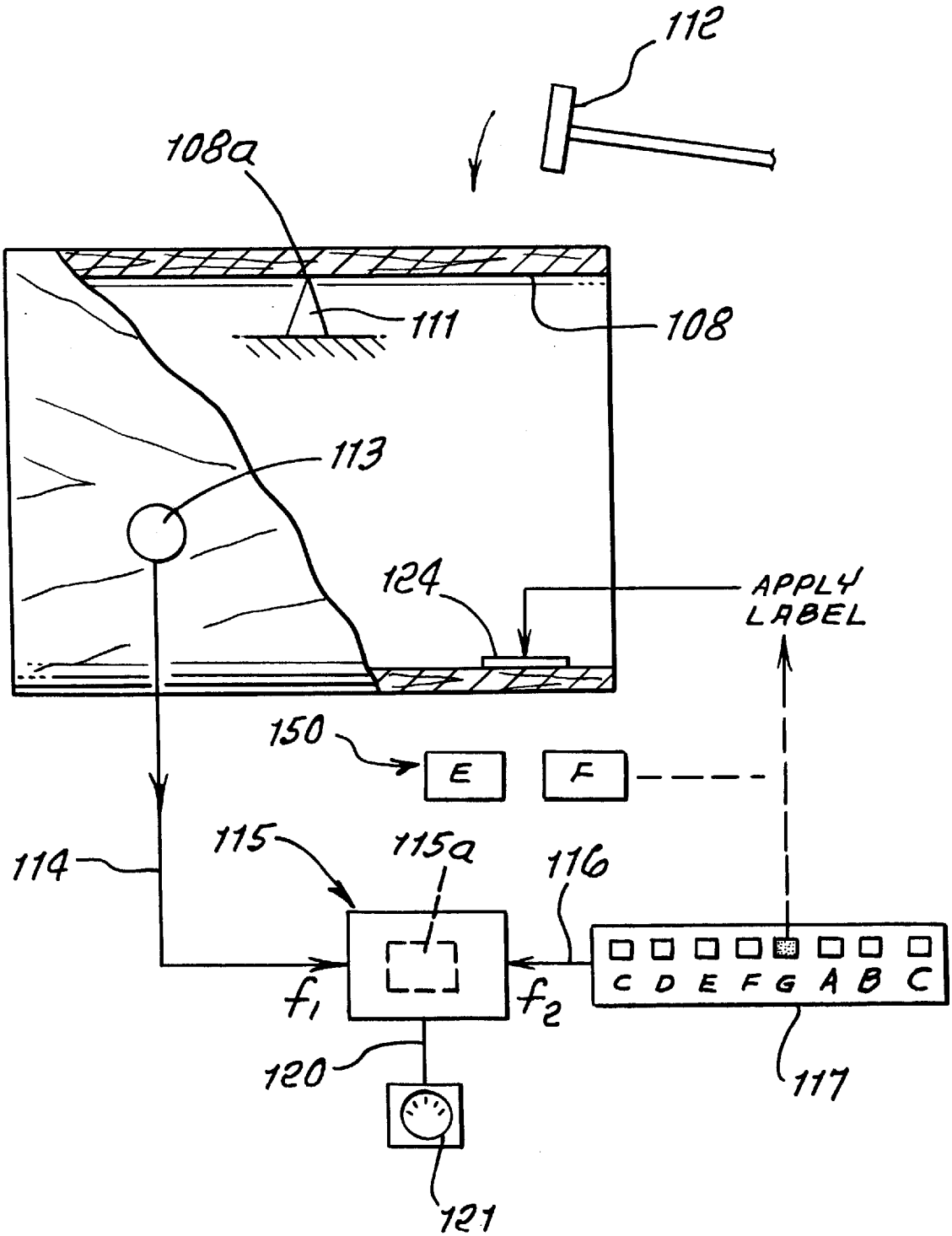

FIG. 2 shows the shell upper interior surface 108 at 108*a* engaged by knife edge 111 to freely suspend the shell to vibrate at its characteristic acoustic or resonant frequency when struck. A hammer to strike the shell is shown at 112.

A sensor 113, such as a microphone, is located near the drum shell to pick up the acoustic output $f_1$ of the resonant output of the drum shell. The microphone output is fed at 114 to circuitry 115, which may include a comparator 115*a*. Also fed to the comparator at 116 is a selectable frequency $f_2$, derived from a tone generator 117. Manually select able tone buttons, corresponding to indicated tones C, D, E, F, G, A, B, C (for example) serve to determine the selected $f_2$ fed to 115. The comparator compares $f_1$ with $f_2$, and when they are the same or nearly the same, as effected by appropriate selection of a button at 117, the comparator output at 120 diminishes to zero or near zero, as indicated on a visual display 121.

The manufacturer then knows what the characteristic resonant tone output of the shell is, as for example corresponds to the selected tone button. The tone button "G" is shown in FIG. 2 as having been selected, as by pushing on that button. The manufacturer then applies a label 124 to the drum interior surface, as by adhesive apparatus, that label bearing the symbol "G". Other labels for selected other tone buttons that correspond to drum shell resonant frequencies are, of course, applicable to shell interior (or exterior) surfaces. See such labels 150.

Referring back to FIG. 1, the drum user, or vendor at point of sale, can then accurately tune the drum. This is done by observing the tone label on the drum shell, operating a tone generator 130 to reproduce that tone, and then tuning the drum to produce the same, or nearly the same, tonal output, when the drum head 12 is struck by a beater. Tuning is effected by tightening or loosening one or more of the head-adjusting rods. The drum is thereby easily tuned to a frequency corresponding to the shell resonant frequency, for optimum acoustic output. Selectable tone buttons 131 are provided at the generator 130.

I claim:

1. In the method of enabling optimum tuning of a drum having a shell, a head and adjustable tuning members, the steps that include:

a) suspending the drum shell to vibrate when struck, b) striking the suspended shell to vibrate at a characteristic acoustic frequency, c) sensing said acoustic frequency and converting the sensed acoustic frequency to a labeling value, d) and using said value to label the drum to indicate said frequency, e) whereby a drum user may tune the drum by adjusting said members to cause the drum to resonate at or near said frequency when the head is struck.

2. The method of claim 1 wherein said sensing includes locating an acoustic vibration pickup transducer at a position to sense said acoustic frequency and to produce an electric signal or signals representative of said frequency, and converting said electric signal or signals into said labeling value.

3. The method of claim 2 wherein said step d) includes applying said label which corresponds to said labeling value to the drum shell surface.

4. The method of claim 3 wherein said label is provided in the form of a tone indicator.

5. The method of claim 4 wherein said applying of the label includes applying said tone indicator in the form of a readable symbol on the drum surface.

6. The method of claim 4 including providing drum shell tension adjustment rods, producing said tone corresponding to said indicator independently of the drum, and including striking the drum head and adjusting said rods until the drum resonates when so struck at a tone level the same as or near said independently produced tone.

7. The method of claim 2 wherein said transducer is provided in the form of a microphone.

8. The method of claim 7 including providing circuitry connected to the microphone and operable to provide a visible indication from which said frequency is determinable.

9. The method of claim 1 wherein said step a) includes suspending the drum by providing a local support engaging the shell surface interiorly of the shell, and at a shell-balancing position.

10. The method of claim 9 wherein said support is provided in the form of a shell supporting local edge.

11. The method of claim 1 including preliminarily buffing said shell.

12. The method of claim 8 wherein said circuitry is provided to include a comparator, and to include a selectable tone generator, the frequency output of which is fed to the comparator for comparison with the frequency output of the microphone.

13. The method of claim 1 wherein said step d) includes applying said label to the drum shell surface.

* * * * *